US011952858B2

(12) United States Patent
Angman et al.

(10) Patent No.: US 11,952,858 B2
(45) Date of Patent: Apr. 9, 2024

(54) ISOLATION TOOL AND METHODS OF USE THEREOF

(71) Applicants: Per Angman, Calgary (CA); Mark Andreychuk, Calgary (CA); Scott Sherman, Blackie (CA)

(72) Inventors: Per Angman, Calgary (CA); Mark Andreychuk, Calgary (CA); Scott Sherman, Blackie (CA)

( * ) Notice: Subject to any disclaimer, the term of this patent is extended or adjusted under 35 U.S.C. 154(b) by 36 days.

(21) Appl. No.: 17/577,298

(22) Filed: Jan. 17, 2022

(65) Prior Publication Data

US 2022/0228457 A1 Jul. 21, 2022

Related U.S. Application Data

(60) Provisional application No. 63/138,302, filed on Jan. 15, 2021.

(51) Int. Cl.

| | |
|---|---|
| ***E21B 33/124*** | (2006.01) |
| ***E21B 23/00*** | (2006.01) |
| ***E21B 23/06*** | (2006.01) |
| ***E21B 34/00*** | (2006.01) |
| ***E21B 34/14*** | (2006.01) |

(52) U.S. Cl.

CPC ..... *E21B 33/124* (2013.01); *E21B 23/06* (2013.01); *E21B 34/14* (2013.01); *E21B 23/00* (2013.01); *E21B 34/00* (2013.01); *E21B 2200/06* (2020.05)

(58) Field of Classification Search

CPC ..... E21B 33/124; E21B 23/06; E21B 34/14; E21B 2200/06; E21B 23/00; E21B 34/00

See application file for complete search history.

(56) References Cited

U.S. PATENT DOCUMENTS

| | | | | |
|---|---|---|---|---|
| 3,845,816 | A * | 11/1974 | Pitts | E21B 33/12955 166/134 |
| 4,606,408 | A * | 8/1986 | Zunkel | E21B 43/10 166/146 |
| 6,474,419 | B2 * | 11/2002 | Maier | E21B 33/1294 166/334.1 |
| 7,451,816 | B2 * | 11/2008 | Corbett | E21B 43/04 166/278 |
| 2002/0162660 | A1 * | 11/2002 | Depiak | E21B 33/124 166/185 |
| 2003/0221829 | A1 * | 12/2003 | Patel | E21B 43/084 166/278 |
| 2007/0235185 | A1 * | 10/2007 | Patel | E21B 17/028 166/278 |
| 2009/0038793 | A1 * | 2/2009 | Schmitt | E21B 47/125 166/250.01 |

(Continued)

*Primary Examiner* — Robert E Fuller
*Assistant Examiner* — Neel Girish Patel
(74) *Attorney, Agent, or Firm* — Parlee McLaws LLP

(57) ABSTRACT

Apparatus and methods are provided relating to bottom hole assemblies (BHA) for the isolation and treatment of selected zones using an uphole and a downhole sealing element. The BHA also includes a location and shifting mechanism for locating, engaging and actuating features in a wellbore. The BHA provides for the selective location and actuation of downhole features such as flow valves, precise introduction of fluid, and real-time monitoring of downhole conditions. Methods of deploying a BHA and treating an area of interest using the BHA includes engaging sealing elements using hydraulic pressure.

7 Claims, 14 Drawing Sheets

(56) References Cited

U.S. PATENT DOCUMENTS

| | | | | |
|---|---|---|---|---|
| 2012/0247767 | A1* | 10/2012 | Themig | E21B 33/146<br>166/321 |
| 2013/0299200 | A1* | 11/2013 | Hughes | E21B 33/124<br>166/321 |
| 2014/0209306 | A1* | 7/2014 | Hughes | E21B 23/00<br>166/279 |
| 2016/0258252 | A1* | 9/2016 | Fripp | E21B 34/14 |
| 2017/0254171 | A1* | 9/2017 | Cleven | E21B 33/124 |
| 2018/0073339 | A1* | 3/2018 | Cleven | E21B 43/25 |
| 2021/0148179 | A1* | 5/2021 | Petrella | E21B 33/1277 |

* cited by examiner

ISOLATION TOOL AND METHODS OF USE THEREOF

CROSS-REFERENCE TO RELATED APPLICATIONS

This application claims the benefit of U.S. Provisional Application 63/138,302 filed Jan. 15, 2021 the entirety of which is incorporated fully herein by reference.

FIELD

Embodiments herein relate to methods and apparatus used for stimulation of wells for improved production. More particularly, embodiments herein relate to an improved bottom hole assembly and isolation tool providing downhole tool locating and actuating capabilities, selective retention of fluid in the tubing string, and real-time monitoring of downhole conditions.

BACKGROUND

Stimulation is performed on a well to increase or restore production. A portion of the well is isolated, meaning that an uphole and a downhole seal are positioned in the well and stimulation fluid is introduced therebetween. Acid stimulation is one form of stimulation used to encourage permeability and flow from an existing well that has become under-productive. In acid stimulation operations, one or more volumes of acid, or acid pills separated by water, are pumped downhole and into the problem formation to stimulate one or more stages or zones of interest. A downhole tool or bottomhole assembly (BHA), is conveyed downhole on a string of conveyance tubing such as coiled tubing (CT) or jointed tubing, and set in the well to isolate the zone of interest accessing the formation to be treated. A bore of the tubing string is in communication with a bore of the BHA to permit fluid communication between surface and the BHA. Isolation of the zone of interest is affected through isolation elements such as cups or packers of the BHA. The isolation elements are typically located uphole and downhole of one or more treatment ports of the BHA configured to permit fluid communication between the bore of the BHA and an annulus formed between the wellbore and the BHA/tubing. The BHA can be positioned such that the isolation elements straddle the zone of interest and direct treatment fluid exiting the BHA via the treatment ports into the formation.

Various isolation tool configurations are currently available. The most common is a "cup-to-cup" tool shown in FIGS. 1A and 1B. Such a tool simply uses two opposing cups located on the BHA with a treatment port therebetween providing communication between the bore of the BHA/tubing and the annulus. The cups are biased to engage the wellbore. Such a tool is simple and economical to manufacture and use but has several operational drawbacks and limitations. For example, as shown in FIG. 1A, when the BHA is run-in-hole (RIH), fluid is pumped from surface into the annulus to collapse the top cup such that the lip of the top cup does not catch any connections or profiles in the wellbore. The injected fluid is returned up to surface via the treatment port and tubing bore. It is sometimes desirable to pump fluid out the "bullnose" or downhole end of the BHA to agitate and clear debris in front of the tool. However, the cup-to-cup tool design does not permit the pumping of fluid out of the bullnose. Additionally, wells typically have large amounts of debris therein, which can damage the lips of the cups as they move along the wellbore. Such problems are more pronounced in long, deviated, or horizontal wellbores. Without proper centralization in deviated or horizontal wellbores, the BHA can ride on the low side, which increases cup wear. Moreover, during treatment, fluid is injected into the wellbore via the bore of the CT and exits via the discharge ports. The cups are then energized by the fluid entering the annulus and seal against the wellbore, such that the only path for the fluid to travel is into the zone of interest. In the event of a frac screen out, the only way to recover the tool is to reverse circulate fluid down the annulus and flush the material up the tubing bore. Forward circulating is not possible until the debris has been cleared and pressures equalized across the cups. Finally, another common issue with cup-to-cup designs is for the downhole cup to swab the wellbore when the BHA is pulled-out-of-hole (POOH), potentially damaging the cup.

An alternative tool design that addresses some of the problems of the cup-to-cup design is a tool having actuable isolation elements that are selectively energized when the BHA has been located at the zone of interest. The BHA can be mechanically, electrically, or hydraulically actuated to energize the isolation elements to engage the wellbore. As the isolation elements are retracted when not energized, such tool designs address the problem of cup wear and swabbing when running the tool in hole or pulling-out-of-hole, thus providing improved reliability and wear characteristics. Such designs also avoid some of the limitations with respect to fluid pumping inherent in cup-to-cup designs.

In some wellbores having downhole flow valves, such as axially actuable sleeve valves, for controlling flow between the wellbore and formation, it may also be necessary to actuate the valve to the open position prior to treatment. The location and actuation of downhole flow valves is typically done with a separate actuation/shifting tool prior to using the isolation tool to treat through the valve. The running in of the shifting tool, location and actuation of the valve, retrieval and removal of the shifting tool from the tubing string, installation of the isolation tool, running back in of the isolation tool, and treatment of the zone of interest is a time consuming and costly process.

For treatment of multiple stages during a single trip, the fluid in the tubing is often arranged in alternating water and acid increments, or pills. After treating one stage, the tool is released, or unset, and to do so it is often required to equalize differential pressure across the isolation elements before they can be moved along the well. Equalization of the pressure can also result in the release of a large portion of the fluid in the conveyance string. The water pill is typically provided for wells that are on vacuum and require water makeup into the formation, circulate a slug of water up the annulus, or for other remedial treatment requiring water injection into the formation. Additionally, many wells, primarily older depleted wells, do not have sufficient reservoir pore pressure to maintain a full column of fluid to surface. Such low pressure wells can be problematic, as fluid in the tubing can be lost due to "U-tubing" between stimulation treatments, different positions, or tool actions in the well.

It is also desirable to provide real-time communication of data between the BHA and surface to enable monitoring of downhole conditions such as temperature, pressure, location, and the like during stimulation operations. While it is known to locate sensors on the BHA configured to acquire and send data to surface, such sensors are typically electrically connected to surface via a physical hardwire connection. Such hardwire connections are difficult to implement on tools having telescoping components or other components that move relative to one another, or where cross-sectional space is limited.

There is interest in the industry for an improved isolation tool for the injection of fluids into a formation that provides for the selective location and actuation of downhole features such as flow valves, precise introduction of fluid, and real-time monitoring of downhole conditions.

SUMMARY

Embodiments of a bottom hole assembly (BHA) for connection to a distal end of conveyance tubing, such as coiled tubing (CT) or jointed tubing, are provided herein for the direction of treatment and/or stimulation fluid through ports in the well and into one or more zones of interest of a formation. In acid stimulation, the fluid is acid and is directed into a formation requiring improvements in formation pore space, and fluid communication generally, for increased hydrocarbon production.

The BHA comprises an isolation tool having isolation elements, such as a well packer or packers, for directing treatment fluid through the ports in the well. For directed treatment to each of the one or more zones of interest, the isolation tool acts as a straddle packer, with the well ports and treatment ports of the tool located between the packers. In embodiments, the isolation elements are hydraulically actuated packers which can be selectively energized using tubing pressure in the conveyance tubing.

The BHA can further include a locating and shifting mechanism for locating, engaging, and/or actuating features in the wellbore such as casing collars and downhole flow valves.

A fluid retention valve can also be located on the BHA between the treatment ports and the tubing string thereabove to provide for the retention of treatment fluid and precise injection thereof during treatment operations. In embodiments, the retention valve has a pressure-released one-way valve for controlled downhole flow of the conveyed treatment fluid. The isolation tool has treatment ports for fluid communication between the packers. In embodiments, the treatment ports can have valves, such as pressure-actuated valves, to provide additional control over the flow of treatment fluid into the wellbore. For treatment, fluid pressure in the tubing bore is raised above a threshold release pressure and the fluid retention valve opens to permit fluid into the isolation tool. Once the treatment is complete, the pump pressure is reduced or turned off and the remaining fluid in the tubing bore uphole of the retention valve is retained or captured therein for use at the next stage.

In embodiments, an electronic instrumentation sub can be incorporated into the BHA and electrically connected to components at surface to receive power therefrom and communicate data therebetween. The instrumentation sub can further be configured to wirelessly send and/or receive data from wireless communication modules positioned at various locations on the BHA. The communication modules are connected to sensors positioned along the BHA. In this manner, data from the sensors can be transmitted to surface in real-time without requiring a hardwire connection between the sensors and the instrumentation sub.

In a broad aspect, a BHA and isolation tool connected to a tubing string for selective treatment of zones of interest of a wellbore includes an upper sealing element and a lower sealing element, a BHA annulus, one or more treatment ports and a locating and shifting tool. The upper sealing element and are each hydraulically actuable between a radially retracted position and a radially engaged position with the wellbore on an activation pressure. The BHA annulus is fluidly connected to the tubing string. The one or more treatment ports fluidly connect the BHA annulus and the wellbore between the upper sealing element and the lower sealing element. When the upper sealing element and the lower sealing element are both in the radially engaged position, a zone of interest between the upper sealing element and the lower sealing element is isolated to enable treatment of the wellbore in the annular space therebetween. The locating and shifting tool has a shifting element hydraulically actuable between a radially biased position with the wellbore on a locating pressure. The shifting element is in the radially biased position for locating and shifting a sleeve.

In an embodiment, the BHA includes a fluid retention valve uphole of the upper sealing element for retaining fluid in the tubing string.

In an embodiment, BHA includes a flow control valve configured to operate between a bypass mode and a flow-through mode. In the bypass mode, fluid from the tubing string is permitted to flow into the wellbore at a high rate and to the BHA annulus at a low rate. In the flow-through mode, fluid from the tubing string is permitted to flow into the BHA annulus at a high rate adequate to meet the activation pressure and the locating pressure.

In an embodiment, the BHA includes an instrumentation sub to wirelessly communicate with one more sensors of the BHA and a controller located uphole the BHA.

In an embodiment, the activation pressure is equal to the locating pressure.

In an embodiment, the BHA includes an expansion joint between the upper sealing element and the lower sealing element. The expansion joint includes a telescoping mechanism activated based on the annular pressure in the BHA annulus between the upper sealing element and the lower sealing element.

In an embodiment, the BHA includes slips to engage the wellbore and retain the BHA within the wellbore.

In an embodiment, the BHA includes one or more hydraulic intensifiers.

In another broad aspect, a method of isolating and treating an area of interest within a wellbore using a BHA includes pumping fluid into the wellbore to position the BHA, pumping water into the wellbore at a locating pressure, radially extending a shifting element of the BHA to a radially biased position, pulling the BHA uphole until the shifting element engages recesses of a sleeve, pumping acid into the wellbore at a locating pressure, pumping acid into the wellbore at an activation pressure, inflating an upper sealing element and a lower sealing element of the BHA, stop pumping acid, waiting for pressure uphole and downhole the BHA to equalize, retracting the upper sealing element and the lower sealing element, retracting the shifting element, and pulling the BHA uphole to the next area of interest.

BRIEF DESCRIPTION OF THE DRAWINGS

FIG. 1A is an illustration of a prior art cup-to-cup isolation tool as it is run-in-hole, fluid being reverse-circulated downhole in the annulus and up the conveyance tubing to assist with run-in;

FIG. 2A illustrates the isolation tool in a run-in-hole position, wherein the isolation elements are retracted;

FIG. 2B illustrates the isolation tool in a treatment position, wherein the isolation elements are energized by hydraulic pistons in reaction to bore pressure in the isolation tool;

FIG. 3A illustrates the isolation tool in a run-in-hole position, wherein the isolation elements and dogs are retracted;

FIG. 3B illustrates the isolation tool in a treatment position, wherein the isolation elements and dogs are energized by hydraulic pistons in reaction to bore pressure in the isolation tool;

FIG. 4A illustrates the isolation tool in a run-in-hole position, wherein the isolation elements and dogs are retracted, and the expansion joint is in the retracted position;

FIG. 4B illustrates the isolation tool in a treatment position, wherein the isolation elements and dogs are energized by hydraulic pistons in reaction to bore pressure in the isolation tool, and the expansion joint is in the expanded position in reaction to pressure between the isolation elements;

FIG. 5A illustrates the isolation tool in a run-in-hole position, wherein the isolation elements and dogs are retracted, and the expansion joint is in the retracted position, and the hydraulic jay valve located uphole of the isolation tool is in a bypass position for permitting flow from the conveyance string bore into both the isolation tool and the wellbore;

FIG. 5B illustrates the isolation tool of FIG. 5A in a treatment position, wherein the hydraulic jay valve is in a flow-through position for directing fluid flow in the conveyance string into the isolation tool and blocking flow into the wellbore via the jay valve, the isolation elements and dogs are energized by hydraulic pistons in reaction to bore pressure in the isolation tool, and the expansion joint is in the expanded position in reaction to pressure between the isolation elements;

FIG. 5C illustrates the isolation tool in a run-in-hole position, wherein the isolation elements and dogs are retracted, and the expansion joint is in the retracted position, and the hydraulic jay valve located downhole of the isolation tool is in a flow-through position for permitting fluid in the BHA bore to flow into the wellbore at high rate without activating the isolation tool;

FIG. 5D illustrates the isolation tool of FIG. 5C in a treatment position, wherein the hydraulic jay valve is in a closed position for blocking flow into the wellbore via the jay valve, the isolation elements and dogs are energized by hydraulic pistons in reaction to bore pressure in the isolation tool, and the expansion joint is in the expanded position in reaction to pressure between the isolation elements;

FIG. 8A illustrates the hydraulic piston biased axially away from the isolation element by the spring such that the isolation element is in a retracted position;

FIG. 8B illustrates the hydraulic piston being urged towards and axially compressing the isolation element by tubing pressure in the BHA such that the isolation element is in an expanded position;

FIG. 9A illustrates a fluid flow path pumping down CT, wherein fluid flow is at pressures <21 mpa;

FIG. 9B illustrates the fluid flow path pumping down CT, wherein fluid flow is at pressure >21 mpa for flow through the valve to the BHA;

FIG. 9C illustrates a reverse flow path uphole through the valve;

DETAILED DESCRIPTION

Figure 1A:
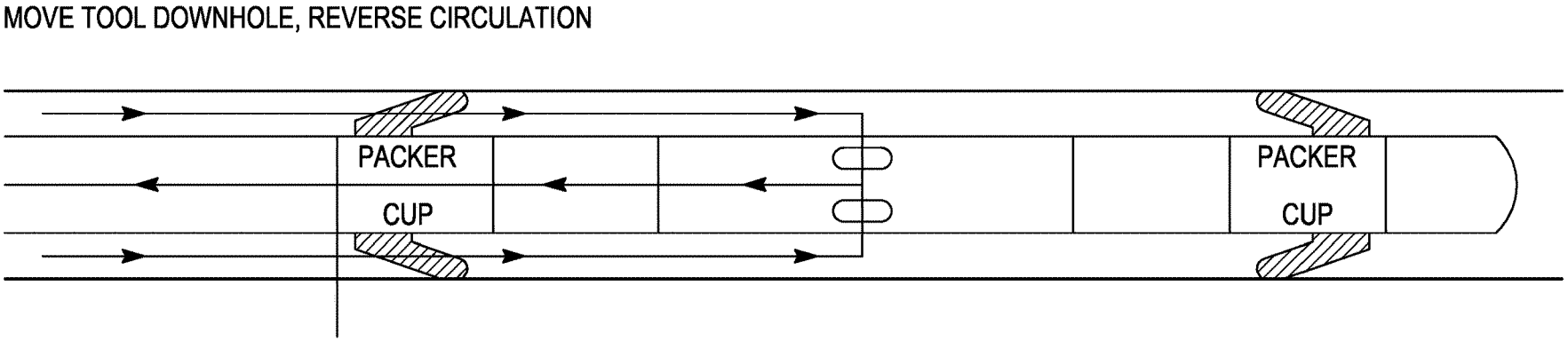
Fig. 1A (Prior Art)
Figure 1B:
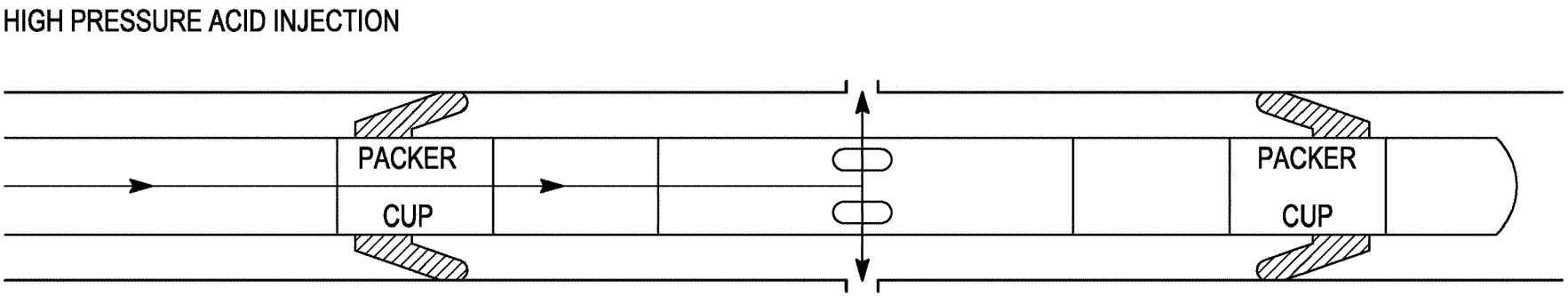
Fig. 1B (Prior Art)
FIG. 1B is an illustration of the prior art isolation tool of FIG. 1A located at a zone of interest, treatment fluid being circulated downhole via the conveyance tubing into the annulus, and the cups of the tool being engaged such that the fluid must flow into the zone of interest of the formation.

Embodiments are described herein in the context of wellbore treatment and stimulation operations. However, as one of skill in the art will understand, systems and methods disclosed herein are also applicable to other operations involving the introduction of fluid to one or more locations along a wellbore.

The terms "uphole" and "downhole" used herein are applicable regardless the type of wellbore; "downhole" indicating being toward a distal end or toe of the wellbore and "uphole" indicating being toward a proximal end or surface of the wellbore.

Generally, an improved BHA having an isolation tool for selective treatment of zones of interest of a wellbore is provided herein. The BHA is advantageous with respect to conventional designs as the improved BHA is capable of locating wellbore features, such as sleeve valves, with a positive locating system. The positive locating mechanism can be a hydraulically actuated mechanism that is controllable via tubing pressure in the conveyance tubing and BHA, such as that disclosed in Applicant's U.S. patent application Ser. No. 17/099,014, filed Nov. 16, 2020 and incorporated herein in its entirety. Such locating mechanism can be either a fluid pressure activated compression element, or an inflatable element, configured to radially extend locating dogs. The locating mechanism can be positioned between the isolation elements of the BHA. The BHA can also have tool actuation capabilities, such as for axially shifting the sleeve valve using tubing pressure after locating same. This is useful for positive sleeve shifting even in deep wells, where the weight of the CT alone may not be sufficient to shift a sleeve downhole.

The BHA can also comprise a fluid retention valve located uphole of the treatment ports of the isolation tool to ensure that fluid in the tubing is retained therein in situations where the annulus may not be full of fluid, or annular pressure is otherwise insufficient to retain fluid in the tubing via hydrostatic pressure alone.

In embodiments, the BHA can comprise an instrumentation sub and wireless communication modules connected to various sensors positioned about the BHA. The instrumentation sub can be located uphole of the isolation tool and connected to components at surface, such as via wireline. The wireless communication modules can be located adjacent and connected to various sensors of the BHA, and configured to wirelessly communicate with the instrumentation sub. The instrumentation sub and wireless communication modules can be configured to communicate via any suitable medium and protocol, such as via acoustic signals, Bluetooth, or other wireless technology. For example, pressure sensors can be located above the uphole isolation element, between the uphole and downhole isolation element, and below the downhole isolation element, to monitor the integrity of the isolation elements in real-time as well as the treating pressure of the treatment operation. An example of a suitable instrumentation sub is that described in Applicant's U.S. patent application Ser. No. 16/481,435, published as US20190345779A1, on Nov. 14, 2019, incorporated herein in its entirety, and in Applicant's U.S. patent application Ser. No. 17/112,634, filed Dec. 4, 2020, incorporated herein in its entirety.

Figure 2A:
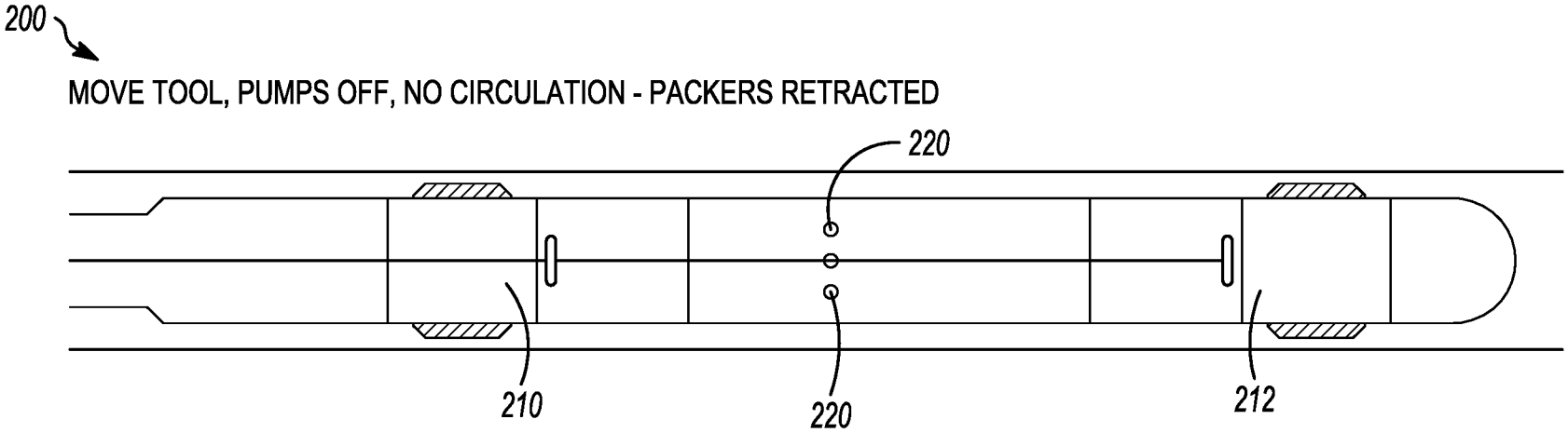
FIGS. 2A and 2B are schematic cross-sectional views of an embodiment of a BHA having an isolation tool, the isolation tool comprising uphole and downhole hydraulically actuated isolation elements and treatment ports positioned therebetween.
Figure 2B:
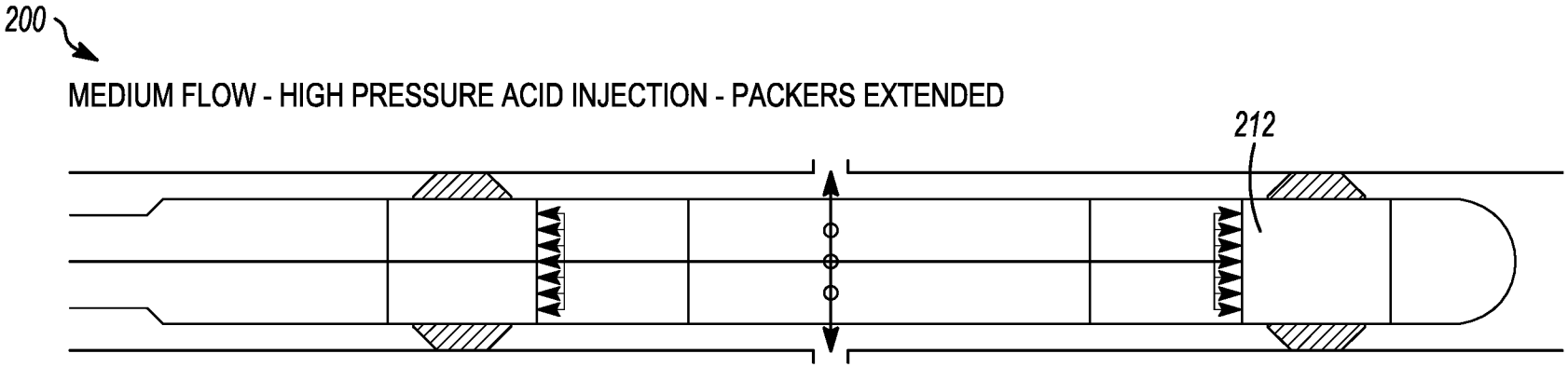
Figure 2C:
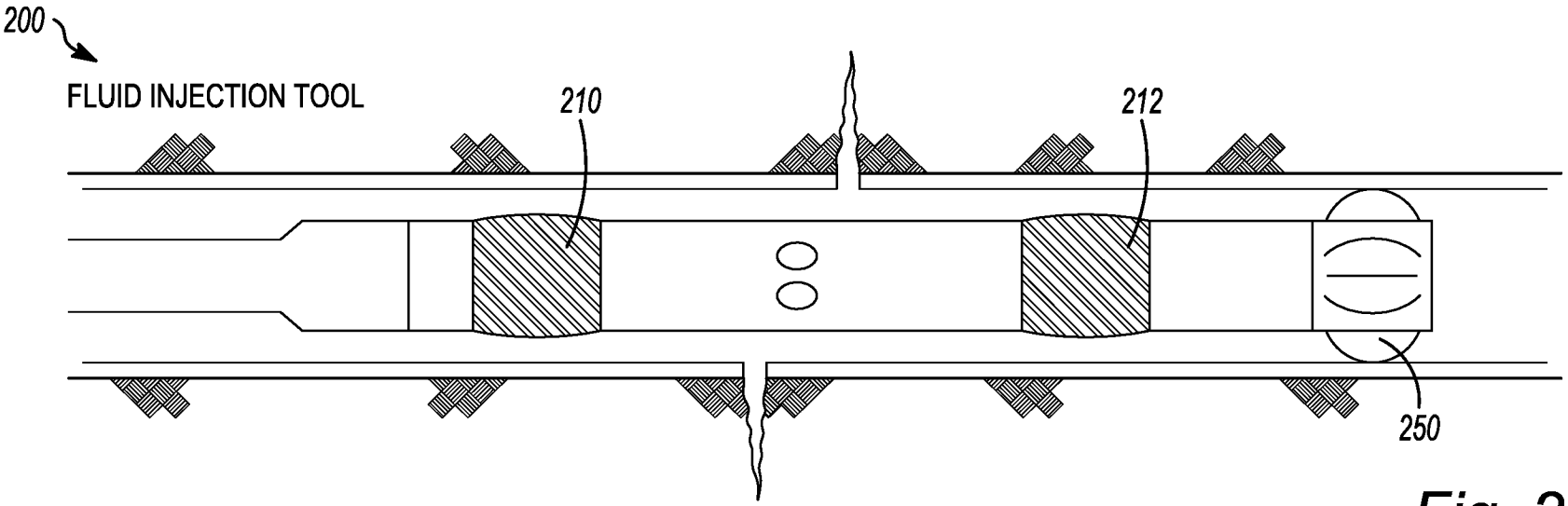
FIG. 2C is a schematic cross-sectional view of another embodiment of a BHA having an isolation tool, instrumentation sub, and a collar locator for positioning the BHA.

In detail, with reference to FIGS. 2A and 2B, an embodiment of the BHA 200 can comprise an isolation tool having hydraulically actuated upper 210 and lower 212 sealing or isolation elements respectively located uphole and downhole of treatment ports 220 of the BHA. The isolation elements 210, 212 are in a radially retracted position when pressure in the BHA 200 and tubing string is below an activation pressure, such as when fluid is not being pumped downhole to the tubing from surface, or is being pumped at a low rate.

Referring to FIGS. 2A to 7B, the pressure applied by fluid pumped down the tubing is represented by fluid flow lines drawn down the tubing and BHA 200. When fluid is blocked, at a BHA component, the line has a "T" crossline. When the fluid is flowing, the line has arrowheads. When a drawing illustrates a high flow rate and a low flow rate, the high flow has a thicker line (See FIGS. 5A and 5B).

The isolation elements 210, 212 can be axially compressible or inflatable so as to radially expand and sealingly engage the wellbore in reaction to tubing pressure reaching or exceeding the activation pressure. As the pump rate of fluid into the tubing is increased and the tubing pressure reaches the activation pressure, the isolation elements 210, 212 radially expand, creating a seal in the casing or open hole which then isolates the wellbore to enable treatment of the wellbore in the annular space or area between the isolation elements 210. 212.

Figure 8A:
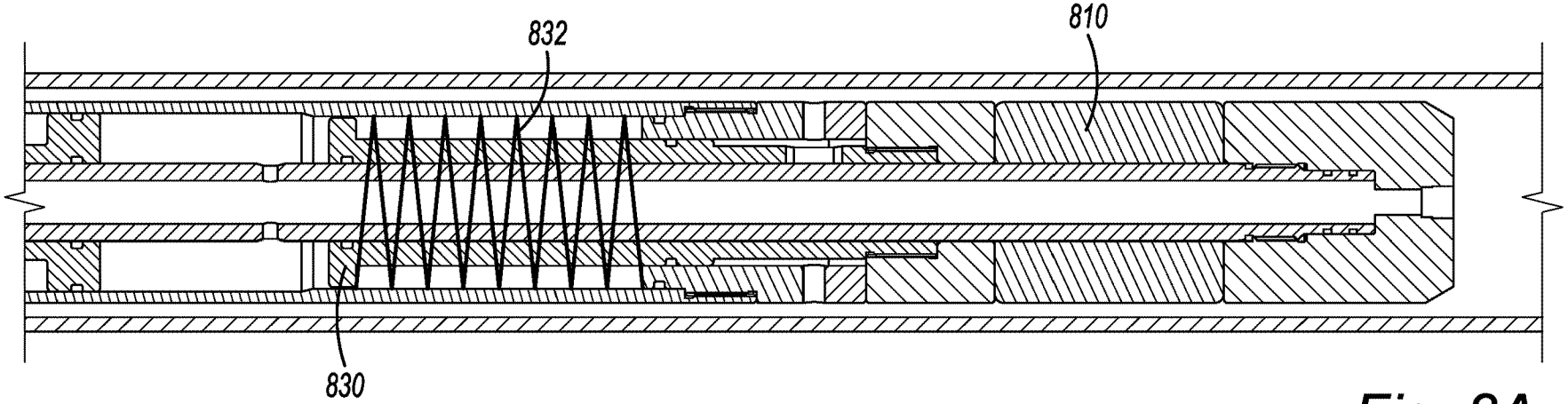
FIGS. 8A and 8B are detail cross-sectional views of an embodiment of a BHA showing a spring-biased hydraulic piston and isolation element.
Figure 8B:
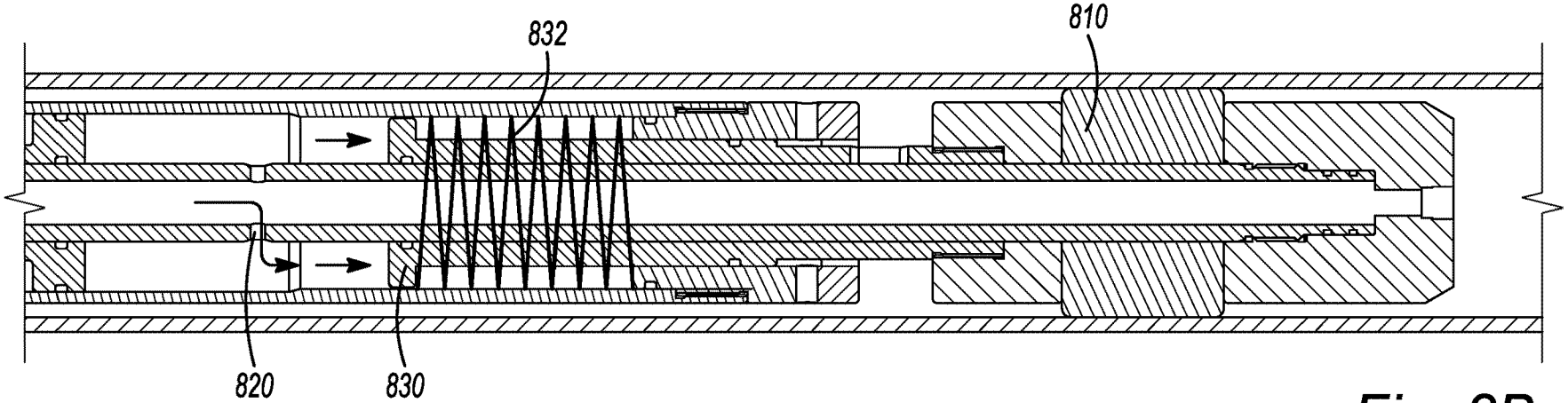

In an embodiment, as shown in FIGS. 8A and 8B, the upper and lower isolation elements are each located between respective axial stops and respective upper and lower hydraulic pistons are configured to be axially displaced toward the isolation elements once the activation pressure has been reached or exceeded in the tubing, thereby compressing the isolation elements between the hydraulic pistons and axial stops. In the FIGS. 8A and 8B, only a downhole packer 810 and hydraulic piston 830, and one end of the uphole piston are illustrated. Upper and lower 832 return springs can be located between the upper and lower 830 hydraulic pistons respectively and respective upper and lower 832 spring stops to bias the hydraulic pistons away from the isolation elements (FIG. 8A). When activated fluid pressure is in fluid communication with the piston through a fluid port 820. The hydraulic pistons are forced hydraulically against the packers, axially compressing their respective isolation elements, causing them to radially expand and engage the wellbore casing or open hole (FIG. 8B). To retract the isolation elements, the flow rate of fluid into the tubing string can be reduced such that tubing pressure falls below the activation pressure. The hydraulic pistons are then driven away from their respective isolation elements by the return springs, thereby radially retracting the elements (FIG. 8A).

Returning to FIG. 2C, the BHA 200 can further comprise a mechanical locator, or collar locator 250, to locate features in the well, such as casing collars or sleeve valves adjacent zones of interest, once located, the isolation elements straddle the treatment port. However, mechanical locators can be unreliable and inaccurate. A more positive location mechanism is preferrable to positively locate wellbore features.

Figure 3A:
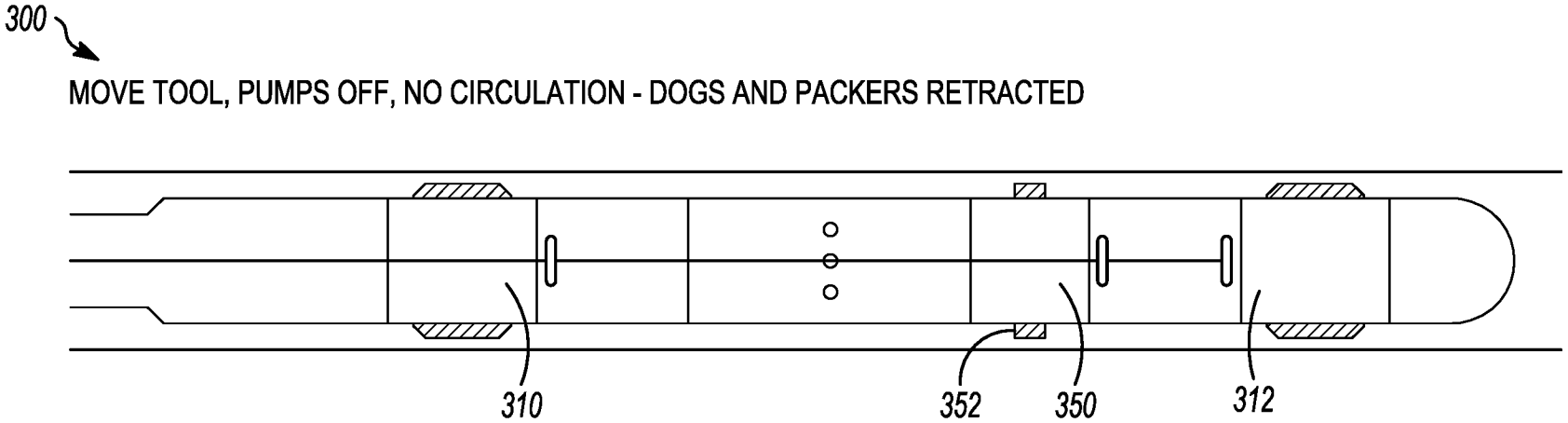
FIGS. 3A and 3B are schematic cross-sectional views of an embodiment of a BHA having an isolation tool, the isolation tool comprising uphole and downhole hydraulically actuated isolation elements and treatment ports positioned therebetween, and hydraulically actuated dogs for locating and actuating downhole tools of the wellbore.
Figure 3B:
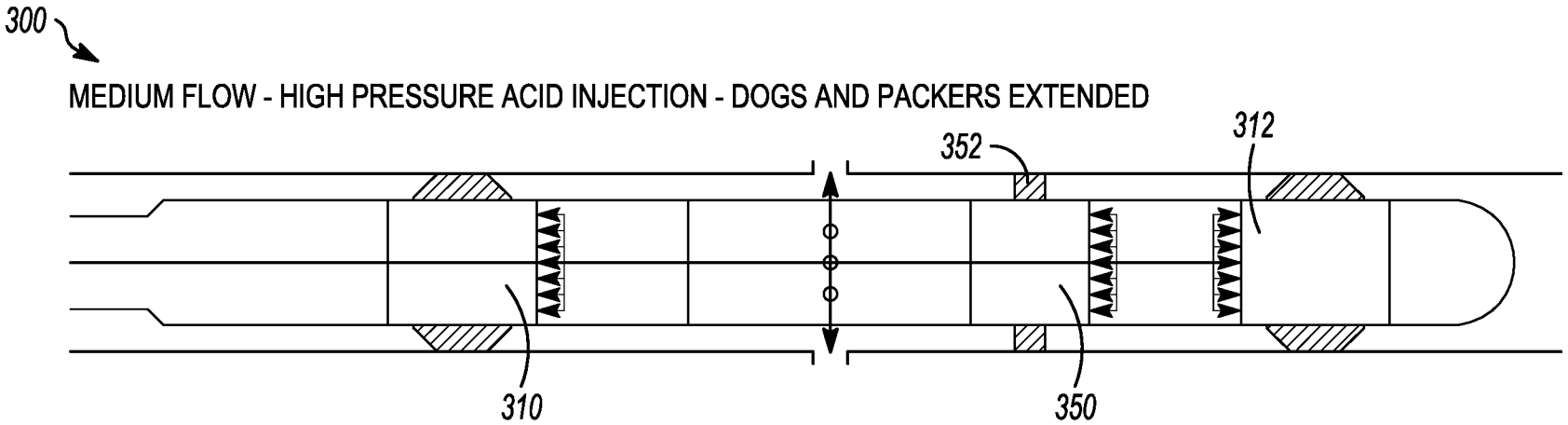

With reference to FIGS. 3A and 3B, a hydraulically actuated location mechanism 350 can be provided on the BHA 300 for positive location of wellbore features. Such a location mechanism 350 can be used in conjunction with surface depth indication to locate a specific point in a well. For running into the well, the hydraulically-actuated components are inactive, permitting free movement in the well without significantly engaging well features and minimizing wear and avoiding damage to the packers 310, 312. The location mechanism 350 can be actuated by increasing tubing pressure to or above a locating pressure, and the BHA 300 can be pulled uphole or run downhole as required to locate the entry point from the casing to the reservoir or zone of interest. For example, as shown in FIGS. 3A and 3B, hydraulically actuated dogs 352 can be located, such as located axially between the upper and lower isolation elements 310. 312, and configured to radially extend to engage the wellbore in response to tubing pressure reaching or exceeding the locating pressure.

As shown in FIG. 3A, prior to treatment of a zone of interest, the locating mechanism 350 can first be activated and the BHA 300 moved uphole or downhole, the locator dragging on the inner wall of the well, until the desired feature in the well has been located, the location of which is noted by a weight change at surface. At FIG. 3B, the isolation packers 310, 312 can then be activated by raising tubing pressure to the activation pressure, or to a second higher pressure, to actuate the isolation packers 310, 312 and isolate the zone of interest. Thereafter, the treatment fluid may be pumped down the tubing and into the zone. Once treatment operations at the zone are complete, the surface pump can be stopped or slowed to reduce the tubing pressure to below the activation and locating pressures such that the isolation packers 310, 312 and the hydraulic dogs 352 are retracted (FIG. 3A), permitting the BHA 300 to move to a new location in the well or retrieved to surface.

In an exemplary embodiment, the locating mechanism comprises a tubular cage of dog collet which has a nominal diameter less than that of the inside of the well. When actuated for locating a well feature having a larger diameter, such as a casing collar, the collet is energized to expand and a radial upset or dog is driven forcibly outward to engage the well. The dog collet is energized using a tubular dog packer located axially between an axial stop and a hydraulically-actuated dog piston, and a dog return spring located between a dog spring stop and the dog piston to bias the dog piston away from the dog packer. The tubular dog collet is located axially coincident with, and radially outwardly of, the dog packer, the dog collet comprising one or more axially extending beams having locating dogs extending radially, or upset, therefrom. The dog piston is configured to be driven radially into the dog packer in response to tubing pressure, for example, once the tubing pressure has reached or exceeded the locating pressure, thereby radially expanding the dog packer and driving the locating dogs radially outwards. When the tubing pressure is reduced to below the locating pressure, the dog return spring urges the dog piston away from the dog packer, thus radially retracting the dog packer and the dogs. The spring force of the beams of the dog collet also assists in radially retracting the locating dogs. An example of such a hydraulically actuated locating dog mechanism can be found in Applicant's U.S. application Ser. No. 17/099,014, filed Nov. 16, 2020, the entirety is incorporated herein by reference. In other embodiments, the dogs can be driven radially outwards using other means, such as by an inflatable packer as opposed to a compressible dog packer.

The locating pressure of the location mechanism 350 and activation pressure of the isolation elements 310, 312 can be the same or different pressures. If the activation and locating pressures are the same, the activated isolation elements 310, 312 can simply drag along the wellbore until the locating mechanism 350 has located the desired feature, at which time the pump rate and tubing pressure would be increased to the desired treating rate and pressure. Typically the locating elements are only actuated once the BHA 300 has been generally placed downhole and adjacent the portion of the wellbore to be treated. Thus, the amount of movement and dragging of the isolation elements 310, 312 is minimized. Alternatively, different activation and locating pressures can be selected such that the isolation elements 310, 312 and locating mechanism 350 can be activated at different times. For example, the locating pressure can be selected to be lower than the activation pressure, such that the locating mechanism 350 is activated first to locate the desired feature with the isolation elements 310, 312 only minimally actuated, if at all. Once the feature is located, the tubing pressure can be increased to the activation pressure to set the isolation elements 310, 312 and the zone of interest can be treated.

As mentioned above, the locating mechanism 350 can also be used as a position the BHA 300 at, engage, and actuate downhole tools, such as sleeve valves having axially slidable sleeves for blocking or exposing flow ports thereof. Such sleeve valves may be shifted by engaging the sleeve, such as a shifting profile of the sleeve, with the locating mechanism 350, and pulling the tubing string uphole to actuate the sleeve uphole or setting the tubing string down to actuate the sleeve downhole. In long, deviated, or horizontal wells, the weight of the tubing string alone may not be sufficient to shift a selected sleeve downhole. In such situations, additional force may need to be applied to shift the sleeve downhole. In this embodiment, such additional force can be an axial jacking force, or hydraulic force applied to the hydraulic dogs.

Figure 4A:
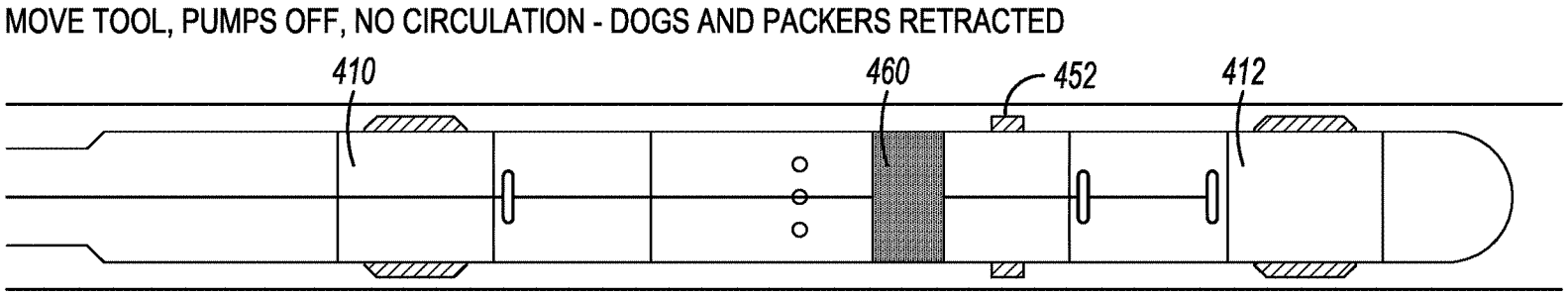
FIGS. 4A and 4B are schematic cross-sectional views of an embodiment of a BHA having an isolation tool, the isolation tool comprising uphole and downhole hydraulically actuated isolation elements, treatment ports positioned therebetween, hydraulically actuated dogs for locating and actuating downhole tools of the wellbore, and an expansion joint for permitting axial movement of the dogs relative to the conveyance string in response to pressure between the isolation elements.
Figure 4B:
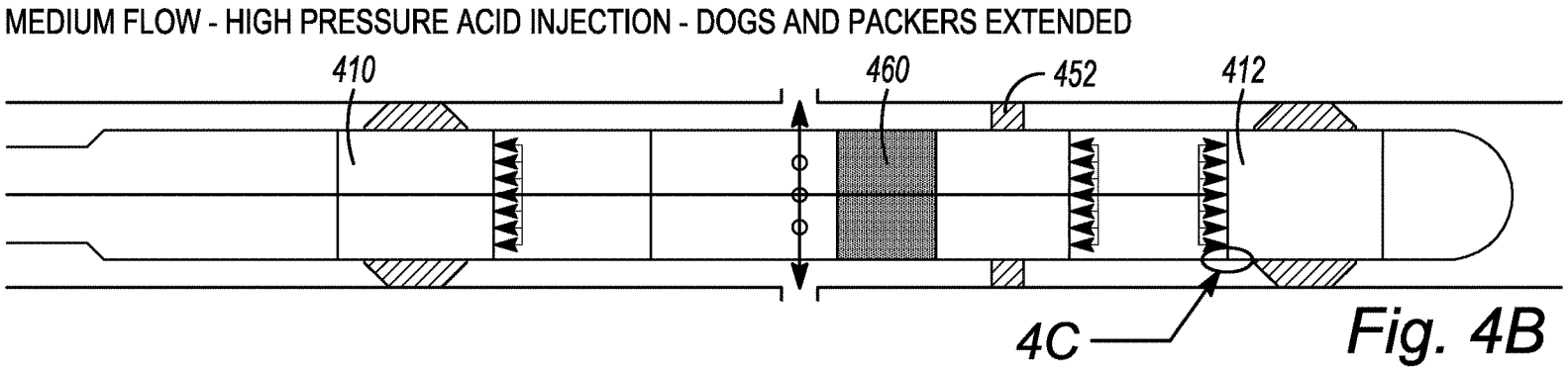
Figure 11:
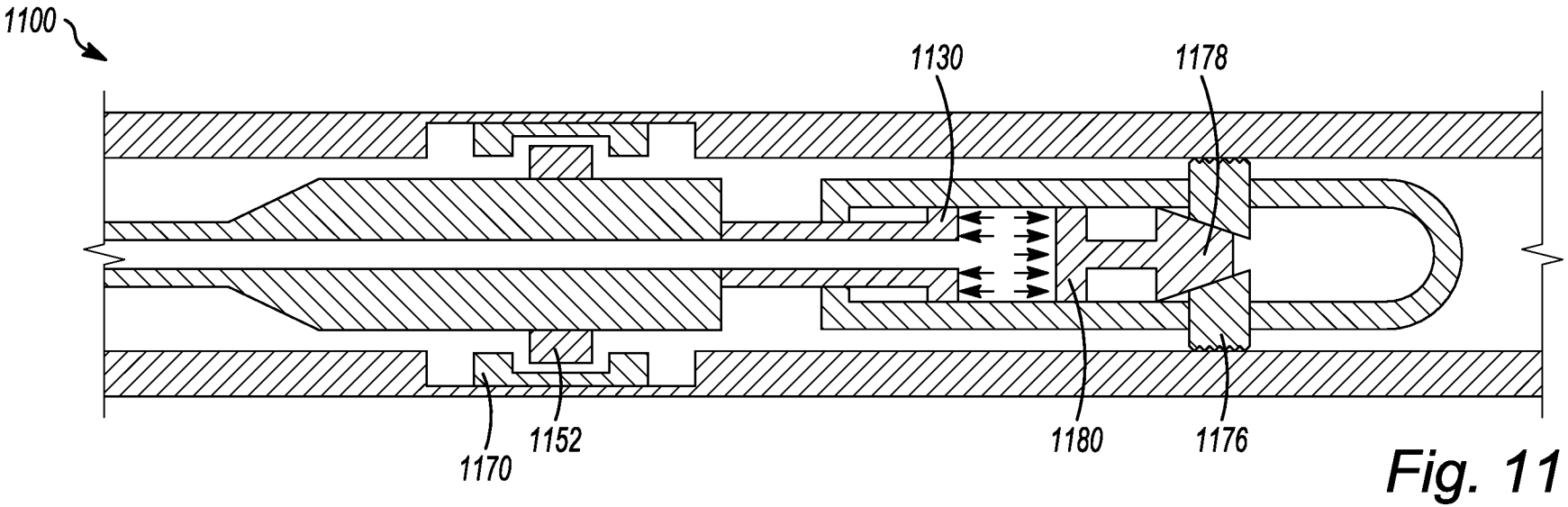
FIG. 11 is a schematic arrangement of a stroking hydraulic dog for sleeve operation and a slip-anchored lower housing that can also support the lower housing and downhole packer relative to the casing during shifting of a sleeve.

With reference to FIGS. 4A, 4B, and FIG. 11, an expansion joint 460 may be provided on the BHA 400 to aid in the shifting of a sleeve valve. The expansion joint 460 can be a freely telescoping mechanism, such as a mandrel and housing, connecting the portions of the BHA 400 uphole and downhole thereof. The expansion joint 460 permits the hydraulic dogs 452 to be manipulated uphole or downhole relative to the BHA 400, and thus relative to one of the upper isolation element 410 or downhole isolation element 412. The expansion joint 460 enables the use of annular pressure between the upper and lower isolation elements 410, 412 to aid in the shifting of a sleeve uphole or downhole depending on the orientation of a hydraulic stroking piston.

In one embodiment, as shown in FIG. 11, after the BHA 1100 has been properly positioned in the wellbore and the dogs 1152 engaged with a sleeve 1170 and increase in pressure in the BHA 1100 actuates a piston 1130 to axially shift the expansion portion, supporting the hydraulic dogs 1152 uphole. If the piston is located uphole of the hydraulic dogs 1152, not shown, or if the pressure is applied to the other side of a piston, not shown, then the hydraulic dogs 1152 and sleeve shifting will be in the opposing direction.

In another embodiment using telescopic action alone, after the BHA has been properly positioned in the wellbore using the locating mechanism, the tubing can be lowered downhole to collapse the expansion joint relative to the downhole isolation element, and both the uphole and downhole isolation elements can be set. As the portion of the annulus between the isolation elements is in communication with the tubing bore, tubing pressure can then be increased to the point where the downhole force applied on the lower or downhole isolation element due to the pressure differential between the tubing pressure and well pressure is great enough to shift the hydraulic dogs, dragging the expansion joint to an extended position.

Figure 4C:
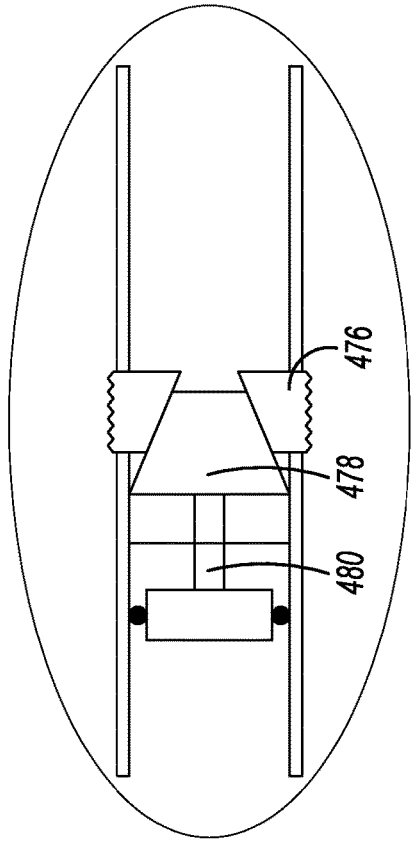
FIG. 4C is a detail view of slips in the downhole hydraulically actuated isolation element of the isolation tool of FIG. 4B comprising dogs and a cone piston configured to engage the dogs.

In order to stroke or shift sleeve relative to a BHA, the BHA needs to be anchored, else the BHA could move relative to the hydraulic dogs, leaving the sleeve immobile and the packers sliding along the casing. With reference to FIG. 4C and FIG. 11, slips may be employed to engage the casing when the BHA 400, 1100 is activated so as to maintain the balance of the BHA 400, 1100 relative to the casing. In the depicted embodiment, the slips comprise dogs 476, 1176 having ramped inner faces engaging a cone 478, 1178 connected to a hydraulic cone piston 480, 1180. The cone piston 480, 1180 can be configured to be hydraulically driven axially towards the dogs 476, 1176 in response to tubing pressure. The engagement of the cone 480, 1180 with the ramped inner faces of the dogs 476, 1176 causes the dogs 476, 1176 to extend radially outwards and into the bore or casing wall of the wellbore as the cone 478, 1178 is driven axially theretowards. Once engaged with the bore wall, the dogs 476, 1176 arrest further axial movement of the corresponding portion of the BHA 400, 1100, in this embodiment the downhole portion, such that tubing pressure can be used to activate the isolation elements without prematurely actuating the expansion joint to the extended position. Such slips may be used in any embodiments having an expansion joint in order to arrest movement of the upper or of the lower BHA portion. The slips can be apparatus commonly used with resettable bridge plugs or packers. Other suitable mechanisms may be used to actuate the slips, such as the packer-and-dog-collet mechanism used for the locating dogs.

As the locating mechanism is still engaged with the sleeve, and is located on the lower portion of the BHA, the sleeve is forced downhole with the lower BHA portion. The increased tubing pressure also more forcefully engages the locating mechanism with the sleeve to prevent inadvertent disengagement. In embodiments having shift-downhole-to-open sleeve valves, the zone of interest is now ready to be treated. The BHA with expansion joint can also be used with pull-up-to-open sleeve valves, to shift the sleeves downhole to close the sleeve valves. Alternatively, the expansion joint can be located downhole of the locating mechanism, for example to assist in actuating sleeves uphole.

In an exemplary embodiment, the BHA can be used to shift a sleeve downhole as follows: 1) run-in-hole RIH the BHA below the sleeve, 2) start the tubing pump to activate hydraulic dogs, 3) pull-out-of-hole POOH the BHA to locate a selected sleeve, 4) RIH, stack coiled tubing CT weight on BHA to max load. If the sleeve does not shift downhole from tubing weight alone, increase fluid rate and increase tubing pressure to activate the isolation elements creating a separation force between the isolation elements, and a downhole force on the downhole isolation element, forcing them apart. Combined with the tubing compression load, the lower isolation element will slide downhole, shifting the sleeve, 5) In embodiments, where the sleeve is shifted downhole to open the flow ports, once the sleeve has been shifted, treat the zone through the flow ports.

In some embodiments, a holddown sub or slip can be located on the top portion of the BHA to prevent the pressure between the isolation elements pushing the upper portion of the BHA uphole as opposed to the lower portion of the BHA downhole, for example in the event that the coefficient of friction between the lower isolation element and the casing is higher than that of the upper isolation element and casing. Said slips can be mechanically actuated or hydraulically actuated in a manner similar to the locating mechanism.

With reference to FIGS. 5A to 5D, a flow control valve/hydraulic jay valve 590, such as that described in Applicant's U.S. application Ser. No. 17/099,014, filed Nov. 16, 2020, can be located uphole or downhole of the isolation tool of the BHA 500 to selectively permit pumping of fluid into the wellbore at high rate to clear debris from the wellbore without activating the isolation elements or locating mechanism of the isolation tool. As more fully described in Applicant's U.S. application Ser. No. 17/099,014 filed Nov. 16, 2020, the flow control valve 590 can be actuated between various flow modes by alternatingly increasing tubing pressure above a threshold pressure of the flow control valve 590 and decreasing tubing pressure therebelow. When tubing pressure is below the threshold pressure, the flow control valve 590 is biased to a low flow mode.

Figure 5A:
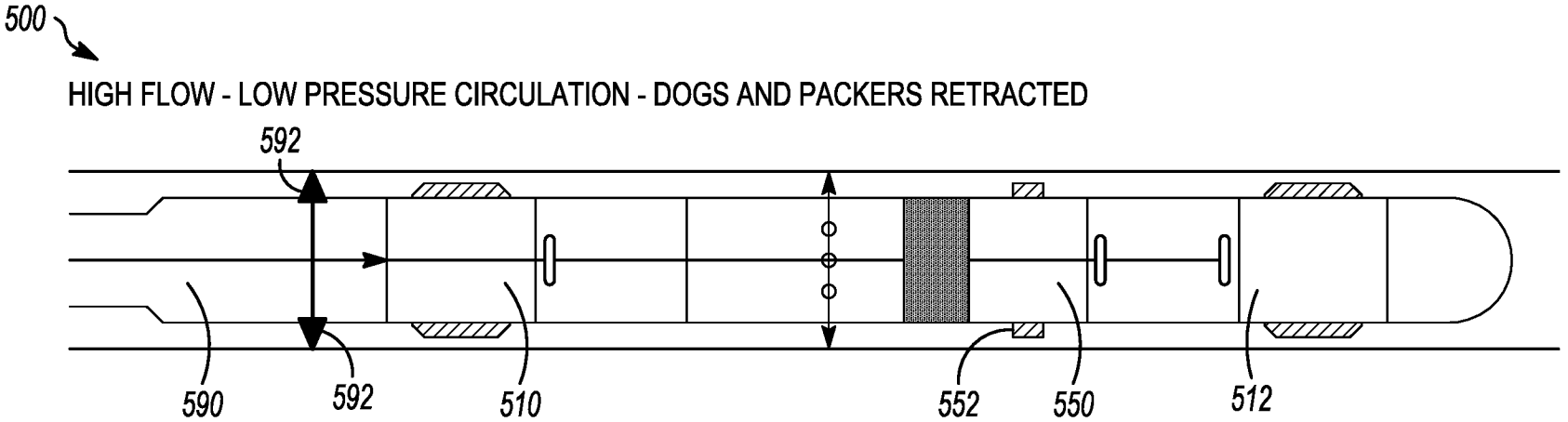
FIGS. 5A through 5D are schematic cross-sectional views of an embodiment of a BHA having an isolation tool, the isolation tool comprising uphole and downhole hydraulically actuated isolation elements, treatment ports positioned therebetween, hydraulically actuated dogs for locating and actuating downhole tools of the wellbore, and an expansion joint for permitting axial movement of the dogs relative to the conveyance string in response to pressure between the isolation elements, the BHA further having a flow control valve/hydraulic jay valve for selectively permitting flow from the conveyance tubing into the wellbore at high rate without activating the isolation tool.
Figure 5B:
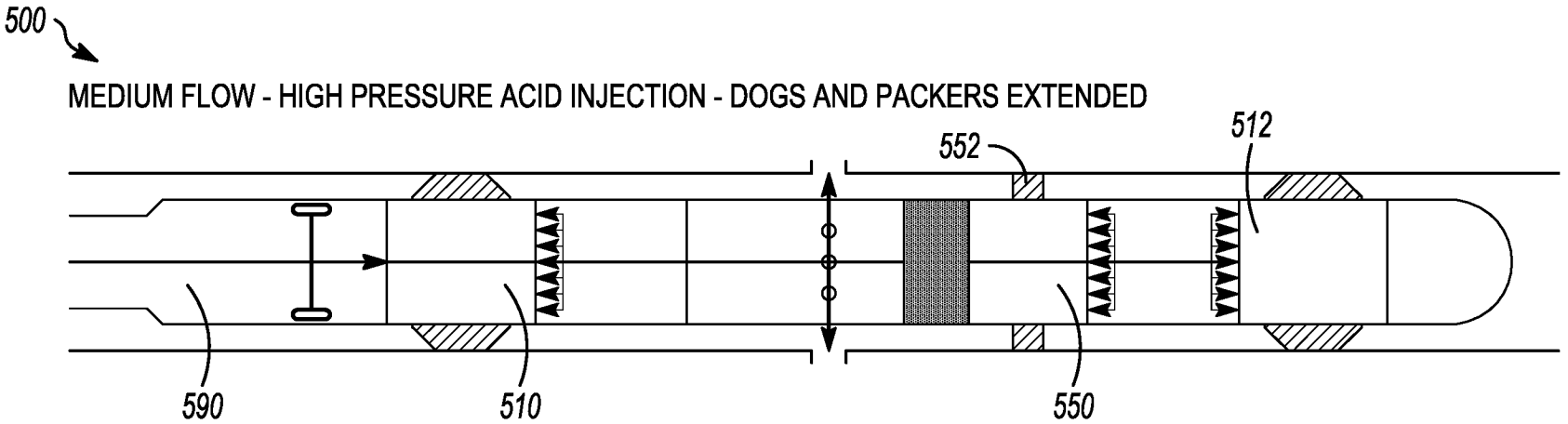

In embodiment depicted in FIGS. 5A and 5B, when tubing pressure is increased to meet or exceed the threshold pressure, the flow control valve 590 actuates to either a bypass mode or a flow-through mode. In the bypass mode, as shown in FIG. 5A, fluid in the conveyance string is permitted to flow into the annulus via bypass ports 592 at a high rate, as well as into the isolation tool at a low rate. In the bypass mode, the pressure in the isolation tool is not able to build up sufficiently to activate the isolation elements 510, 512 or locating mechanism 550, thereby permitting fluid to be pumped at high rates without activating the isolation tool. In one embodiment, the high rate can be used to clear debris from sleeve valves as the BHA 500 is pulled uphole for straddling the now clean sleeve valve.

In the flow-through mode, as shown in FIG. 5B, at a high rate of flow the flow control valve 590 blocks the bypass ports 592 and the majority of the fluid in the conveyance string is directed downhole into the isolation tool. As the majority of the flow is no longer relieved to the well annulus, the pressure in the isolation tool is permitted to reach or exceed the activation and locating pressures to activate the isolation elements 510, 512 and locating mechanism 550. The activation pressure on the BHA 500 components is illustrated in the drawing as multiple distributed pressure or force arrows on the uphole isolation packer 510, the hydraulic dogs 552 and the downhole isolation packer 512. A small bleed flow of fluid to the annulus is shown (thin flow lines) which the flow control valve 590 can bleed down to reset to the bypass mode.

The flow control valve 590 can be configured to alternate between the bypass and flow-through modes by cycling the tubing pressure to meet or exceed, and then fall below, the threshold pressure. A J-mechanism permits a selected sequence of modes that can be temporarily locked in a mode and fluid flow cycled to a next mode.

Figure 5C:
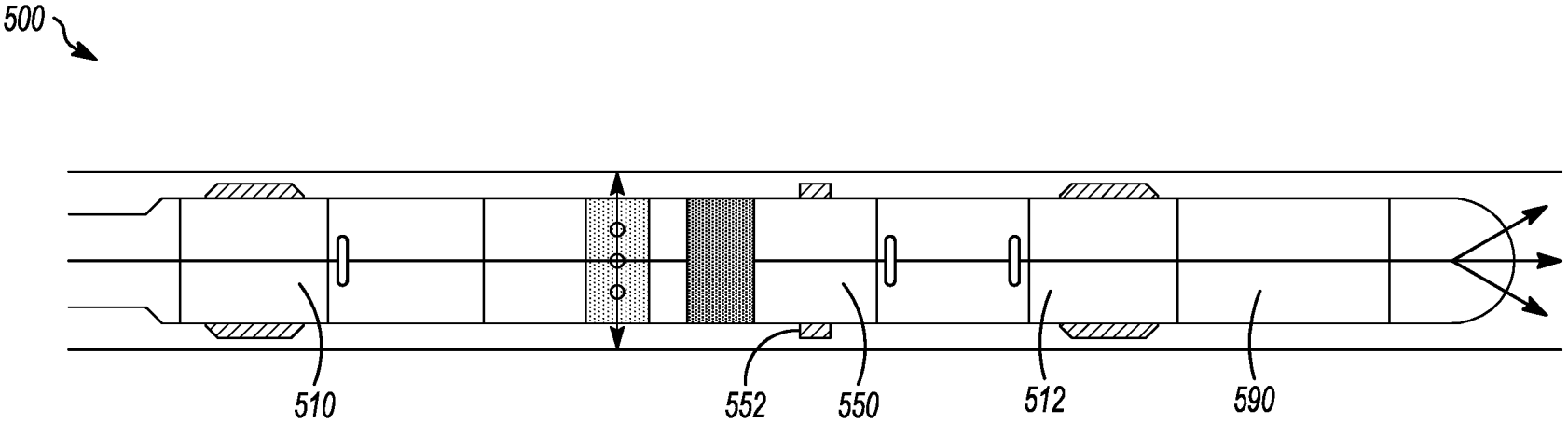
Figure 5D:
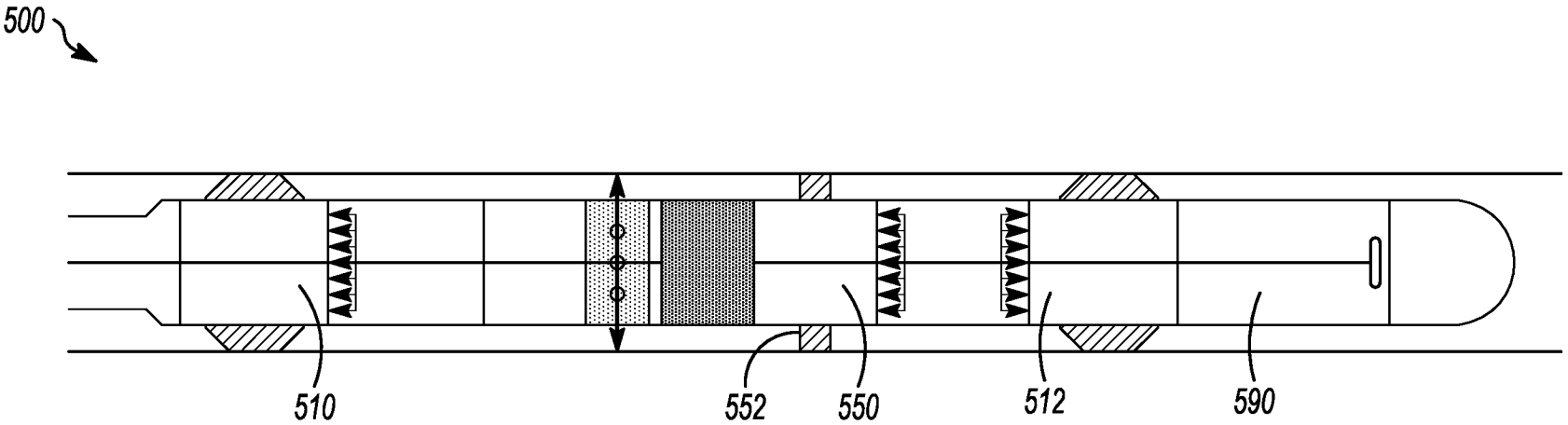

With reference to FIGS. 5C and 5D, in embodiments, the flow control valve 590 can be located downhole of the isolation tool. In such embodiments, when tubing pressure is increased to meet or exceed the threshold pressure, the flow control valve 590 actuates to either a flow-through mode or a treatment mode. In the flow-through mode, fluid in the conveyance string is permitted to flow through the isolation tool and flow control valve 590, through the BHA 500, and into the wellbore at high rates, and pressure in the isolation tool is not able to build up sufficiently to activate the isolation elements 510, 512 or locating mechanism 550, thereby permitting fluid to be pumped at high rates without activating the isolation tool.

In the treatment mode, the flow control valve 590 is closed and no flow is permitted therethrough and thus no flow out of the downhole end of the BHA. The only flow path for fluid in the conveyance string is through the discharge ports of the isolation tool and into the restrictive flow path of formation outside the well, thus permitting pressure in the isolation tool to reach or exceed the activation and locating pressures to activate the isolation elements 510, 512 and locating mechanism 550. As above, the flow control valve 590 can be configured to alternate between the flow-through and treatment modes, such that the flow control valve 590 can be alternatingly actuated between the modes by cycling the tubing pressure to meet or exceed, and then fall below, the threshold pressure. Locating the flow control valve 590 at the downhole end of the BHA 500 is advantageous, as flow can be directed out of the downhole end in the flow-through mode to clear debris from the path of the BHA 500 as it advances downhole.

Figure 6A:
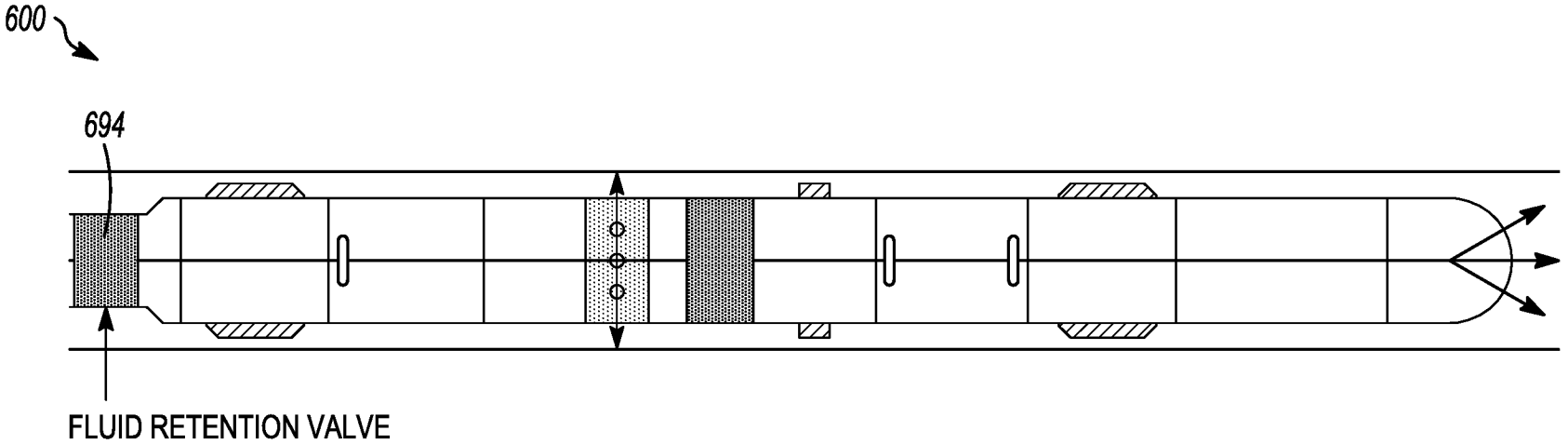
FIGS. 6A and 6B are schematic cross-sectional views of an embodiment of a BHA having an isolation tool, the isolation tool comprising uphole and downhole hydraulically actuated isolation elements, treatment ports positioned therebetween, hydraulically actuated dogs for locating and actuating downhole tools of the wellbore, and an expansion joint for permitting axial movement of the dogs relative to the conveyance string in response to pressure between the sealing elements, the BHA further having a flow control valve/hydraulic jay valve for selectively permitting flow from the conveyance tubing into the wellbore without activating the isolation tool, and a fluid retention valve located uphole of the isolation tool.
Figure 6B:
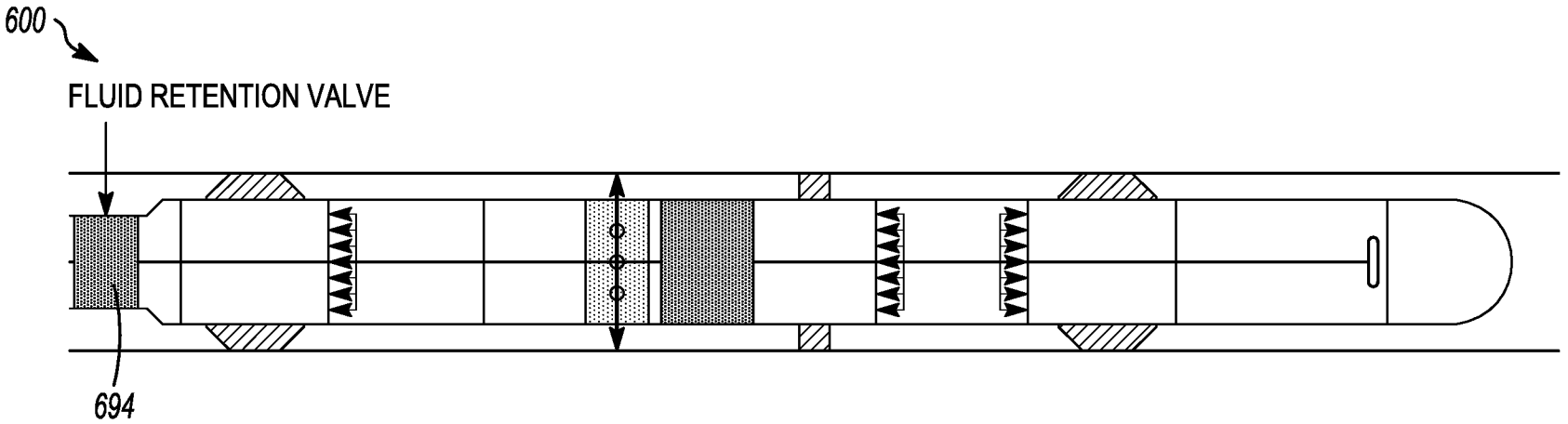

With reference to FIGS. 6A and 6B, the BHA 600 can also comprise a fluid retention valve 694, also known as an unloader valve, located uphole of the isolation tool for retaining fluid in the tubing string in situations where the wellbore is not filled with fluid and there is a risk of fluid in the tubing string otherwise "U-tubing" into the annulus. The retention valve 694 can be a one-way valve that is biased to the closed position, such as using a spring, and can be opened once the tubing string pressure meets or exceeds a release pressure. Such a retention valve 694 is advantageous as it permits an operator to inject a very specific amount of treatment fluid. Once the injection of treatment fluid is ceased and tubing pressure drops below the release pressure, the retention valve 694 closes, capturing the remaining fluid in the tubing and preventing loss of fluid into the wellbore. In embodiments, such as with alternating pills of treatment and water stacked in the tubing string, such fluid loss is undesirable as then it is nearly impossible to determine how much volume of treatment fluid remains to treat subsequent zones of interest.

For example, with the use of a fluid retention valve, in the treatment of 10 stages, 10 m3 of treatment fluid could be pumped directly into the conveyance tubing. The BHA can be run to target depth to locate the first stage, and 1 m3 of treatment fluid is pumped into the first stage. Pumping can cease after 1 m3 has been injected, fluid pressure in the tubing string would drop below the release pressure, and the retention valve would close, preserving the remaining 9 m3 of treatment fluid for the subsequent 9 stages. Treatment fluid can be pumped into the subsequent stages in a similarly precise manner, minimizing the loss of fluid.

In embodiments, the flow retention valve can be a two-way valve with a reverse circulation capability, where fluid is injected into the wellbore via the annulus and flows back uphole through the discharge ports of the BHA and tubing string. For example, the flow retention valve can comprise an upper piston for permitting flow downhole past the retention valve if the release pressure is met or exceeded, and a lower piston for permitting reverse flow uphole past the retention valve if a second release pressure is met or exceeded. Both the upper and lower pistons can be biased to the closed position with one or more springs.

Figure 9A:
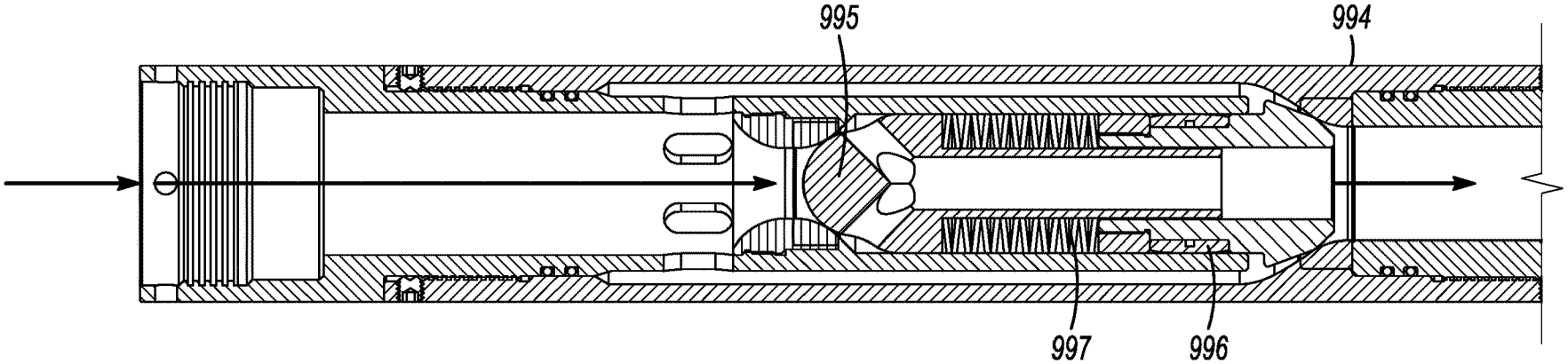
FIGS. 9A to 9C are cross-sectional views of an embodiment of a treatment fluid retention or unloader valve. More particularly.
Figure 9B:
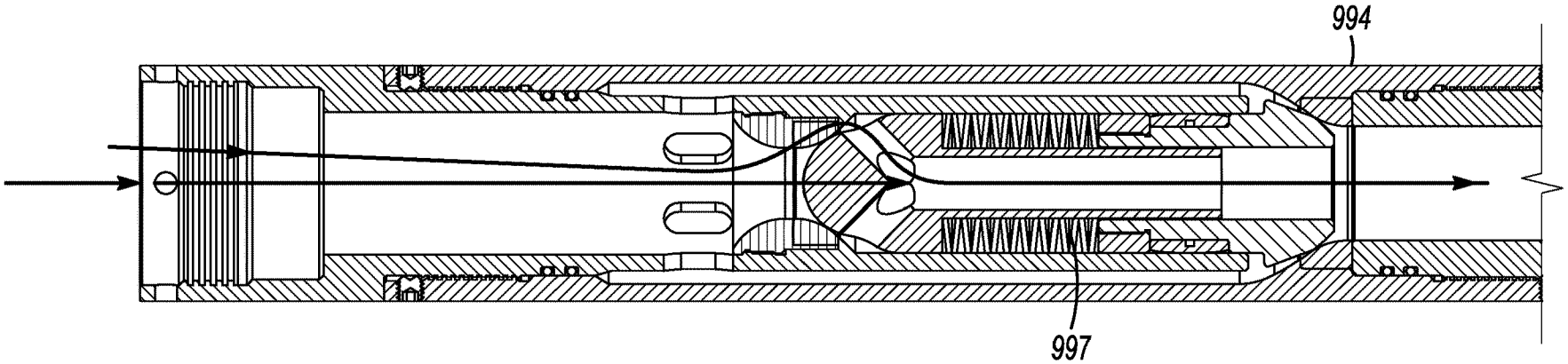
Figure 9C:
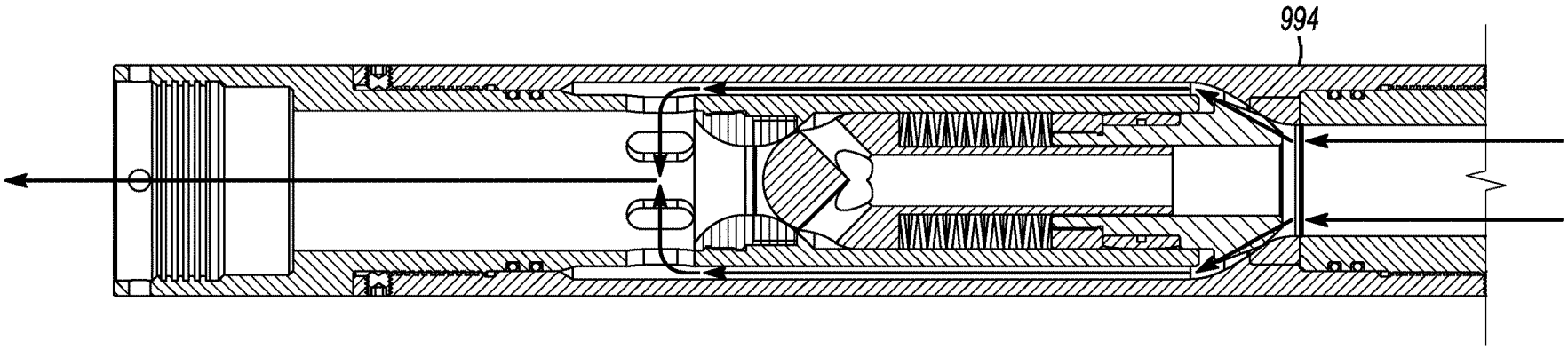

As shown in FIGS. 9A to 9C, one embodiment of a treatment fluid retention or unloader valve 994 comprises a piston 995 and a seal 996. One or more dual acting bellow springs 997 do not compress downhole when flow in the downhole direction is less than 21 mpa. The bellow springs 997 are set with adjustable force to meet the needs of the well application to release at specific pressures. Fluid flow is illustrated with arrows.

Referring to FIG. 9A, the retention valve 994 is shown in in a blocked position. Fluid flow pressure is less than 21 mpa, which is required to overcome the bellow springs 997 to move the piston 995, and therefore piston 995 does not move sealing a fluid pathway.

Referring to FIG. 9B, the retention valve 994 is shown in a flow-through configuration. Fluid flow pressure is greater than 21 mpa generating a required trigger pressure to compress the bellow springs 997 and move the piston 995 to an option position.

Referring to FIG. 9C, an optional a reverse flowpath for reverse circulation uphole through the valve 994 is illustrated.

Figure 7A:
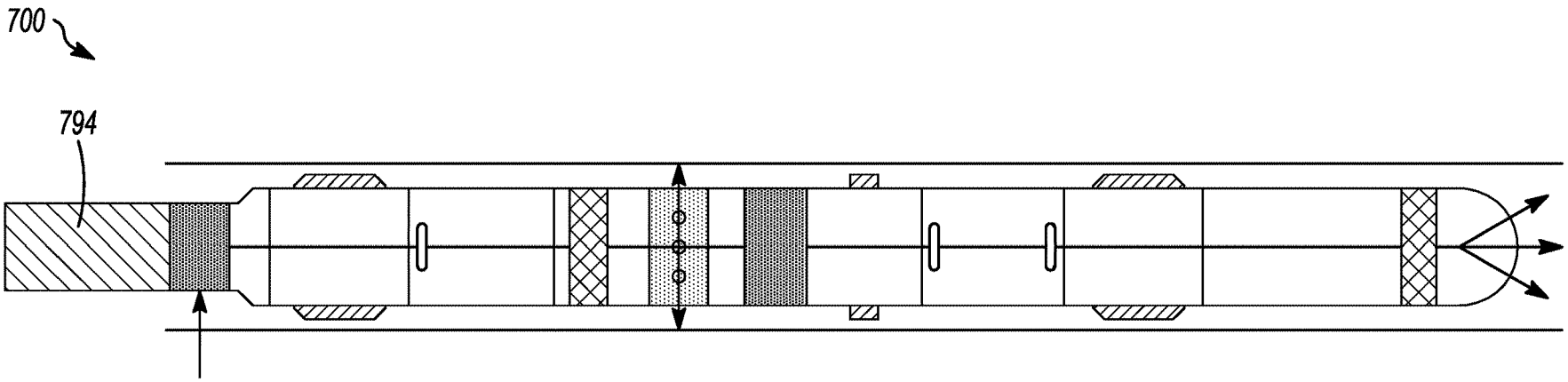
FIGS. 7A and 7B are schematic cross-sectional views of an embodiment of a BHA having an isolation tool, the isolation tool comprising uphole and downhole hydraulically actuated isolation elements, treatment ports positioned therebetween, hydraulically actuated dogs for locating and actuating downhole tools of the wellbore, and an expansion joint for permitting axial movement of the dogs relative to the conveyance string in response to pressure between the isolation elements, the BHA further having a flow control valve/hydraulic jay valve for selectively permitting flow from the conveyance tubing into the wellbore without activating the isolation tool, a fluid retention valve and an instrumentation sub (e.g. "Coil Link") located uphole of the isolation tool, and two short-hop wireless communication modules for communication of data with the instrumentation sub.
Figure 7B:
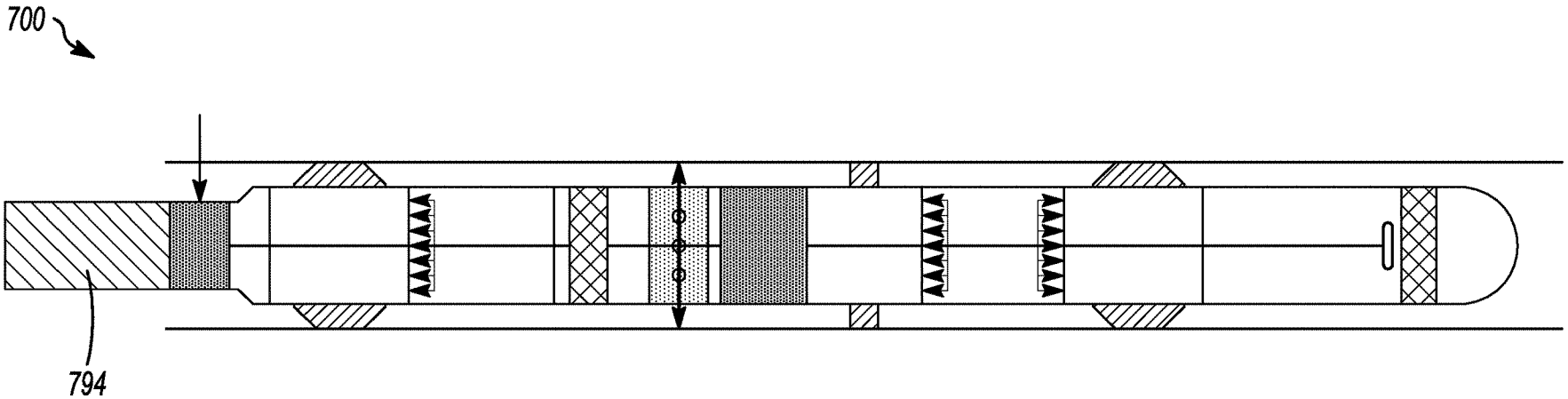

Referring to FIGS. 7A and 7B, in embodiments, an instrumentation sub 794 can be located on the BHA 700. In the depicted embodiment, the instrumentation sub 794 is located uphole of the isolation tool and in electrical communication with surface via any suitable means, such as wireline or electrically-enabled tubing (such as e-coil). Additionally, the instrumentation sub 794 can be configured to be capable of wireless communications, such as via acoustic signals, Bluetooth, or any other suitable communications medium and protocol. One such suitable instrumentation sub is as set forth in Applicant's US Application No. US20190345779A1 filed on Jan. 24, 2018 and incorporated herein in its entirety. In FIG. 7A, the "T" crossline on the left means that no differential pressure is applied. In FIG. 7B, the "T" crossline on the right means that no flow can get through.

Various sensors, such as temperature sensors, pressure sensors, and the like, can be located about the BHA 700. For example, pressure sensors can be located uphole of the upper isolation element, between the upper and lower isolation elements, and downhole of the lower isolation element for determining the pressure differential across the isolation elements during treatment operations. A temperature sensor can be located between the isolation elements to monitor temperature during treatment. The sensors can be connected to wireless communications modules configured to communicate with the instrumentation sub for transmission of sensor data to the surface in real-time or near real-time. The wireless communications modules can receive power from a local power source, such as a battery or capacitor. In embodiments, the wireless communications modules can also be configured to store sensor data to on-board memory. The use of wireless communications modules is advantageous as it does not require the routing of wiring across isolation elements and moving components such as the expansion joint and/or hydraulic pistons.

Figure 10:
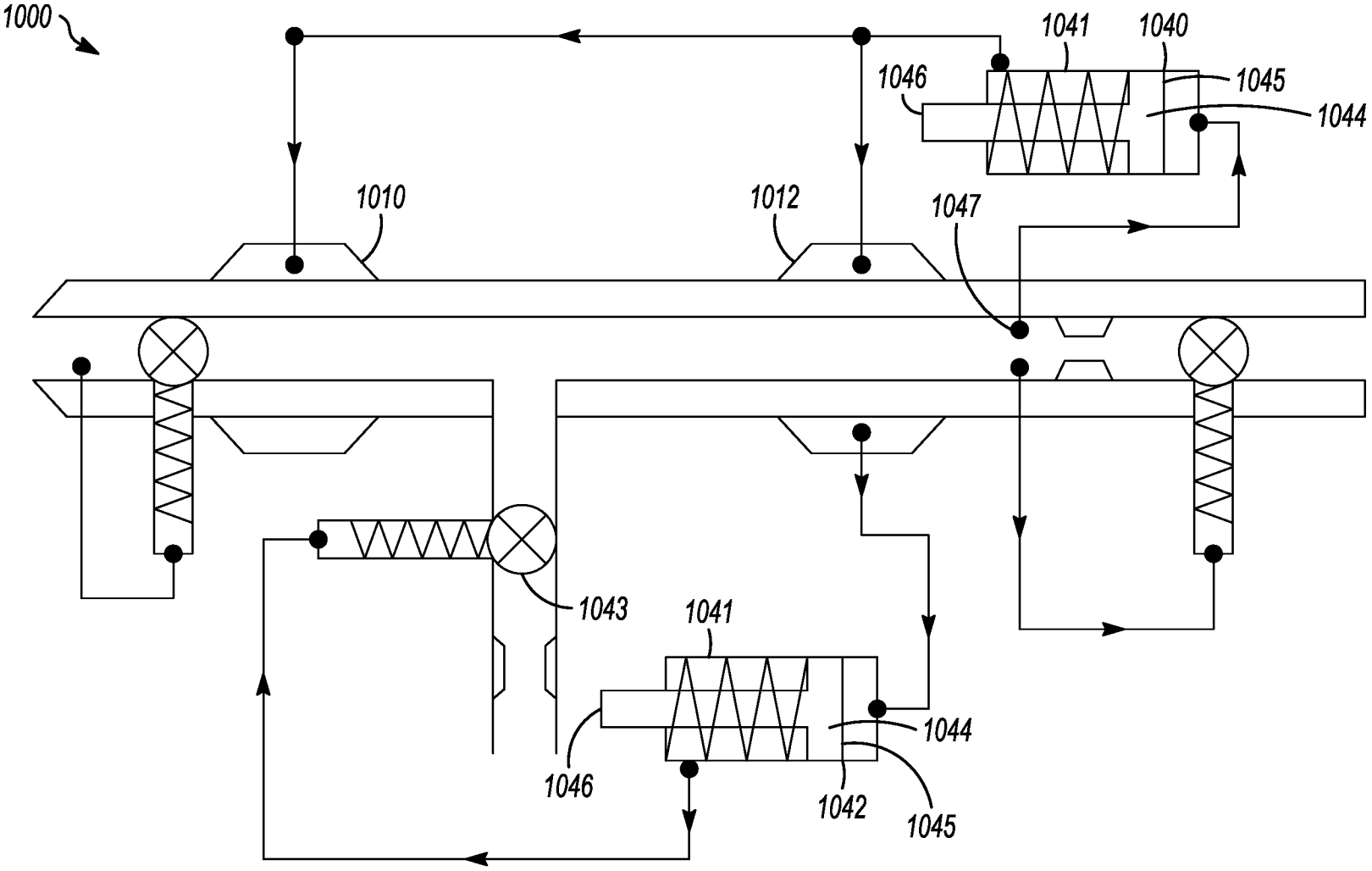
FIG. 10 is a schematic of a hydraulic intensifier usable for inflatable packers and which could be adapted to axial pistons for compressible packers.

In embodiments, with reference to FIG. 10, hydraulic intensifiers can be located at various locations throughout the BHA 1000 to provide an amplification of the hydraulic force exerted on certain components. Such hydraulic intensifiers operate on the principle of the pressure being applied on an input side of a piston, having a relatively larger surface area, resulting in a large amount of pressure on an output side of the piston having a smaller surface area relative to the input side. In the depicted embodiment, return springs can be used in the intensifier to return the piston of the intensifiers to a starting position toward the input side of the intensifier. For example, as shown in FIG. 10, intensifier 1040 is positioned to amplify the tubing pressure applied on the upper and lower isolation elements 1010, 1012, said isolation elements in this case comprising inflatable packers. Additionally, intensifier 1042 is positioned to amplify the tubing pressure and hydraulic force applied on a flow valve 1043 controlling the flow of fluid out of the treatment ports of the BHA 1000. The use of hydraulic intensifiers is desirable as it provides a force advantage and permits the use of a relatively small amount of hydraulic fluid to provide a large amount of pressure and hydraulic force.

In embodiments, an upper isolation element is an upper packer and a BHA also comprises a shifting and treatment tool as taught in Applicant's U.S. application Ser. No. 15/143,368 filed on Apr. 29, 2016 and incorporated herein by reference in its entirety, wherein the shifting and treatment tool comprises a lower isolation element. In embodiments, the BHA further comprises an inner mandrel having an inner mandrel bore defining one or more pressure ports.

In embodiments, the BHA 1000 comprises one or more hydraulic intensifiers 1040. In embodiments, each of the hydraulic intensifiers 1040 comprises a housing 1041 attached to the inner mandrel defining an annular chamber and a piston 1044 slidably attached to the inner mandrel. The piston 1044 is configured to be contained within the chamber and to move along an axial extent therein. The piston 1044 comprises an input side 1045 and an output side 1046. As described above, in embodiments, the input side 1045 has a relatively larger surface area, resulting in a large amount of pressure on the output side 1046 of the piston having a smaller surface area relative to the input side. The output side 1046 of the piston being configured to apply pressure to the upper packer 1010. In embodiments, the input side and the output side comprise ring seals.

The input side 1045 is in fluid communication with one or more pressure ports 1047. When tubing pressure is applied, fluid from the one or more pressure ports 1047 applies pressure on the input side 1045, which is transferred to the output side 1046 and the upper packer 1010. Fluid pressure is provided to the BHA 1000 through the inner mandrel bore and the pressure ports 1047 provide fluid communication between the inner mandrel bore and the input side 1045. As fluid pressure is applied through the inner mandrel bore to the input side 1045 through the pressure ports 1047, pressure is applied to the output side 1046 and to the upper packer 1010 such that it engages the wellbore.

The force applied by tubing pressure is effectively multiplied by the number of hydraulic intensifiers used. The BHA may comprise any number of hydraulic intensifiers as required by the application. In embodiments, the BHA comprises 3 or 4 hydraulic intensifiers.

In an exemplary embodiment, the BHA shown in FIG. 10 can be operated as follows. Initially, the BHA is run in hole. Water is then slowly circulated, for example at 400 L/min and valve 1, which is normally closed, opens. Valve 2 is normally open. The zone of interest is then located and acid is then circulated down at 400 L/min. Once acid is in place in the tubing, the pump rate is increased to about 500 L/min. The pressure drop over nozzle 1 causes valve 2 to close. Pressure is then increased causing intensifier 1040 to act on and open valve 3. Acid is then pumped and injected through nozzle 2. When the acid injection is complete, pumping is stopped. As a result, valve 1 closes, valve 3 closes and valve 2 opens. Once all the pressures have equalized, the packers deflate and intensifiers 1040 and 1042 are deactivated and are reset.

Although a few embodiments have been shown and described, it will be appreciated by those skilled in the art that various changes and modifications can be made to those skilled in the art that various changes and modifications can be made to these embodiments without changing or departing from their scope, intent or functionality. The terms and expressions used in the preceding specification have been used herein as terms of description and not of limitation, and there is no intention in the use of such terms and expressions of excluding equivalents of the features shown and described or portions thereof.

The embodiments in which an exclusive property or privilege is claimed are defined as follows:

1. A bottom hole assembly (BHA) and isolation tool connected to a tubing string for selective treatment of zones of interest of a wellbore comprising an upper sealing element and a lower sealing element, each hydraulically actuable between a radially retracted position and a radially engaged position with the wellbore on an activation pressure;

a BHA annulus fluidly connected to the tubing string;

one or more treatment ports fluidly connecting the BHA annulus and the wellbore between the upper sealing element and the lower sealing element, wherein when the upper sealing element and the lower sealing element are both in the radially engaged position, a zone of interest between the upper sealing element and the lower sealing element is isolated to enable treatment of the wellbore in the annular space therebetween;

a locating and shifting tool having a shifting element hydraulically actuable to a radially biased position with the wellbore on a locating pressure, wherein the shifting element is in the radially biased position for locating and shifting a sleeve; and an expansion joint between the upper sealing element and the lower sealing element comprising a telescoping mechanism activated based on an annular pressure in the BHA annulus between the upper sealing element and the lower sealing element.

2. The BHA of claim 1 further comprising a fluid retention valve uphole of the upper sealing element for retaining fluid in the tubing string.

3. The BHA of claim 1 further comprising a flow control valve configured to operate between:

a bypass mode wherein fluid from the tubing string is permitted to flow into the wellbore at a high rate and to the BHA annulus at a low rate; and a flow-through mode wherein fluid from the tubing string is permitted to flow into the BHA annulus at a high rate adequate to meet the activation pressure and the locating pressure.

4. The BHA of claim 1 further comprising an instrumentation sub to wirelessly communicate with one more sensors of the BHA and a controller located uphole the BHA.

5. The BHA of claim 1 wherein the activation pressure is equal to the locating pressure.

6. The BHA of claim 1 further comprising slips to engage the wellbore and retain the BHA within the wellbore.

7. The BHA of claim 1 further comprising one or more hydraulic intensifiers.

* * * * *